United States Patent [19]

Byers et al.

[11] Patent Number: 4,876,237

[45] Date of Patent: Oct. 24, 1989

[54] THERMALLY-TRANSFERABLE FLUORESCENT 7-AMINOCOUMARINS

[75] Inventors: Gary W. Byers; Derek D. Chapman, both of Rochester, N.Y.

[73] Assignee: Eastman Kodak Company, Rochester, N.Y.

[21] Appl. No.: 238,653

[22] Filed: Aug. 31, 1988

[51] Int. Cl.[4] ..... B41M 5/035; B41M 5/26

[52] U.S. Cl. ..... 503/227; 8/471; 428/195; 428/480; 428/690; 428/913; 428/914

[58] Field of Search ..... 8/471; 428/480, 195, 428/913, 914, 690; 503/227

[56] References Cited

U.S. PATENT DOCUMENTS 4,627,997 12/1986 Ide ..... 428/216

FOREIGN PATENT DOCUMENTS 0179295 9/1985 Japan ..... 503/227

*Primary Examiner*—Bruce H. Hess

*Attorney, Agent, or Firm*—Harole E. Cole

[57] ABSTRACT

A donor element for thermal transfer comprising a support having on one side thereof a fluorescent 7-aminocoumarin compound dispersed in a polymeric binder, and on the other side thereof a slipping layer comprising a lubricant. In a preferred embodiment, the compound has the formula:

wherein: each X and Y independently represents hydrogen; a substituted or unsubstituted alkyl or acyl group having from 1 to about 10 carbon atoms; a substituted or unsubstituted aryl group having from about 6 to about 10 carbon atoms; or the atoms necessary to complete, along with the nitrogen to which it is attached, a 5- or 6-membered heterocyclic ring.

15 Claims, No Drawings

THERMALLY-TRANSFERABLE FLUORESCENT 7-AMINOCOUMARINS

This invention relates to fluorescent donor elements used in thermal transfer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

The system described above has been used to obtain visible dye images. However, for security purposes, to inhibit forgeries or duplication, or to encode confidential information, it would be advantageous to create non-visual ultraviolet absorbing images that fluoresce with visible emission when illuminated with ultraviolet light.

U.S. Pat. No. 4,627,997 discloses a fluorescent thermal transfer recording medium comprising a thermally-meltable, wax ink layer. In that system, the fluorescent material is transferred along with the wax material when it is melted. Wax transfer systems, however, are incapable of providing a continuous tone. Further, the fluorescent materials of that reference are incapable of diffusing by themselves in the absence of the wax matrix. It is an object of this invention to provide fluorescent materials useful in a continuous tone system which have sufficient vapor pressure to transfer or diffuse by themselves from a donor element to a dye-receiver.

In accordance with this invention, a donor element for thermal transfer is provided comprising a support having on one side thereof a fluorescent 7-aminocoumarin compound dispersed in a polymeric binder, and on the other side thereof a slipping layer comprising a lubricant.

In a preferred embodiment of the invention, the compound has the formula:

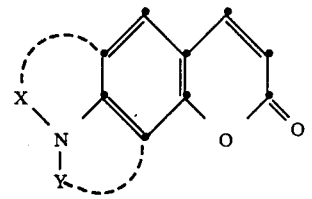

wherein: each X and Y independently represents hydrogen; a substituted or unsubstituted alkyl or acyl group having from 1 to about 10 carbon atoms, such as $—CH_3$, $—C_2H_5$, $—C_2H_4OCH_3$, $$—\overset{O}{\overset{\|}{C}}—C_3H_7,$$

$—COCH_3$, or $—CF_3$; a substituted or unsubstituted aryl group having from about 6 to about 10 carbon atoms such as $—C_6H_5$, $—C_6H_4(p—OCH_3)$, $—C_6H_4(o—CO_2CH_3)$, or $—C_6H_4(p—Cl)$; or the atoms necessary to complete, along with the nitrogen to which it is attached, a 5- or 6-membered heterocyclic ring, such as

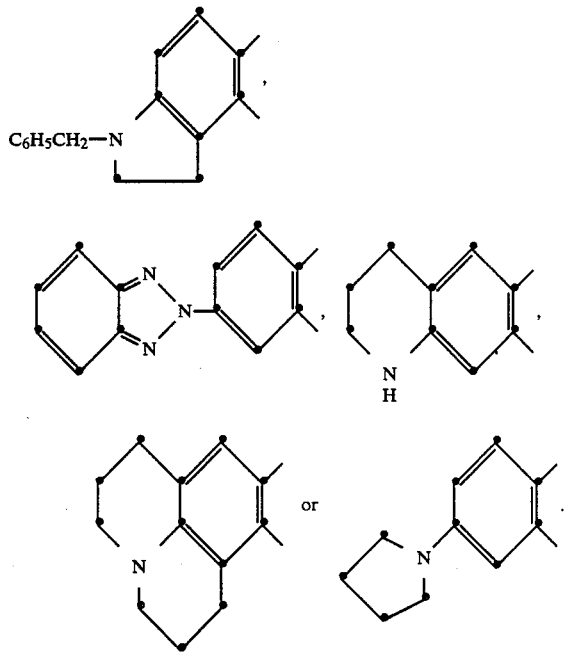

In a preferred embodiment of the invention, X and Y are each hydrogen, methyl, ethyl or represent the atoms necessary to complete a 6-membered heterocyclic ring.

Compounds included within the scope of the invention include the following:

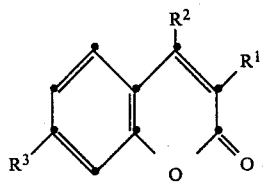

-continued
| Compound | $R^1$ | $R^2$ | $R^3$ |
|---|---|---|---|
| 1 | —H | —$CH_3$ | $N(C_2H_5)_2$ |
| 2 | 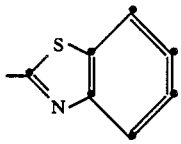 | —H | $N(C_2H_5)_2$ |
| 3 | —H | —$CH_3$ | —$NH_2$ |
| 4 | —H | —$CF_3$ | $N(CH_3)_2$ |
| 5 | —$C_6H_5$ | —H | 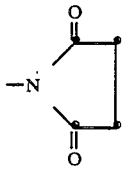 |
| 6 | 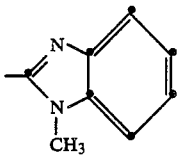 | —H | —$N(C_2H_5)_2$ |
| 7 | —$COCH_3$ | —H | —$N(C_2H_5)_2$ |
| 8 | —H | —$CH_3$ | —$N(CH_3)_2$ |
| 9 | 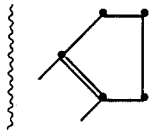 | 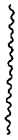 | —$N(CH_3)_2$ |
| 10 | 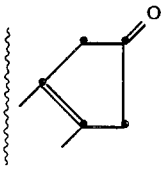 |  | —$NH(CH_3)$ |
| 11 | 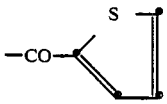 | —H | 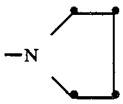 |
| 12 | 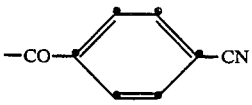 | —H | —$N(C_2H_5)_2$ |
| 13 | —$(CH_2)_2CO_2C_2H_5$ | —$CH_3$ | —$N(CH_3)_2$ |
| 14 | 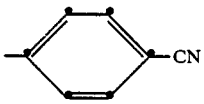 | —H | —$N(C_2H_5)_2$ |
| 15 | —$COC_6H_5$ | —H | —$N(CH_3)_2$ |
| 16 | —H | —H | —$N(CH_3)_2$ |
| 17 | —CN | —H | —$N(C_2H_5)_2$ |
| 18 | —H | —H | —$N(C_6H_5)_2$ |
| 19 | —$CO_2C_2H_5$ | —H | —$N(CH_3)_2$ |

-continued
| | | | |
|---|---|---|---|
| 20 | $-C_6H_5$ | $-H$ | 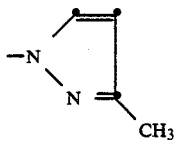 |
| 21 | $-C_6H_5$ | $-H$ | $-NHCOCH_3$ |
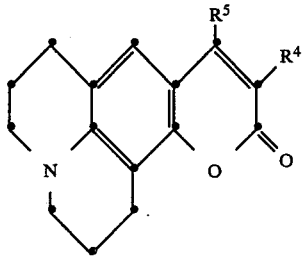
| Compound | $R^4$ | $R^5$ |
|---|---|---|
| 22 | $-H$ | $-CF_3$ |
| 23 | $-COCH_3$ | $-H$ |
| 24 | $-COC_6H_5$ | $-H$ |
| 25 | $-H$ | $-nC_3H_7$ |
| 26 | $-H$ | $-CH_3$ |
| 27 | $-CN$ | $-H$ |
| 28 | $-CO_2C_2H_5$ | $-H$ |
| 29 | 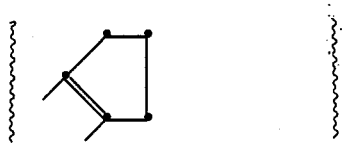 | |
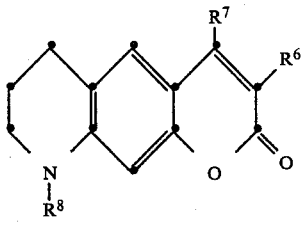
| | $R^6$ | $R^7$ | $R^8$ |
|---|---|---|---|
| 30 | $-H$ | $-CF_3$ | $-H$ |
| 31 | $-H$ | $-CF_3$ | $-C_2H_5$ |
| 32 | $-H$ | $-CH_3$ | $-H$ |
| 33 | $-CH_3$ | $-CH_3$ | $-CH_3$ |
34
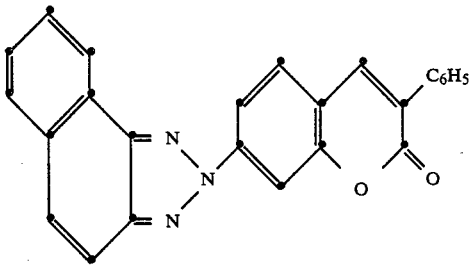
35
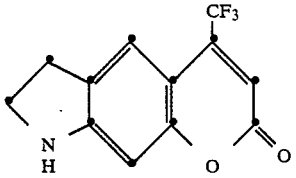

-continued

36

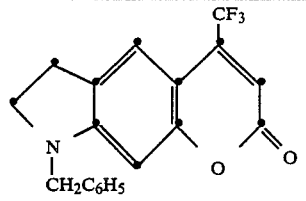

37

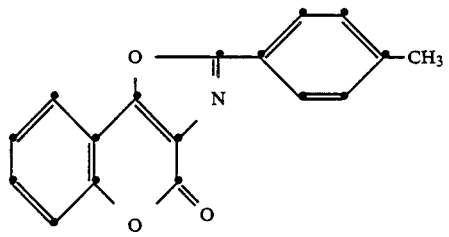

38

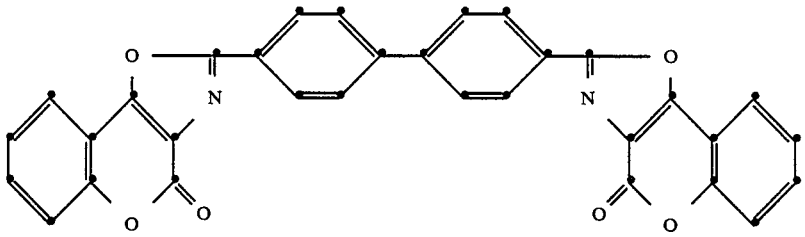

39

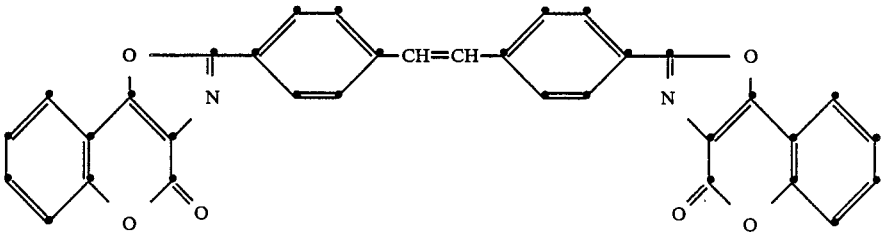

40

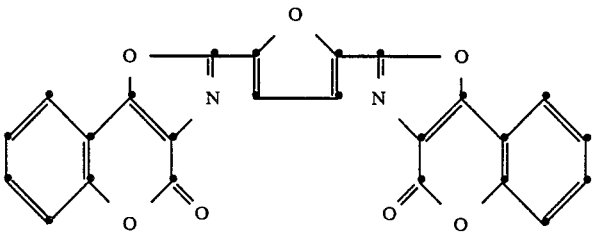

41

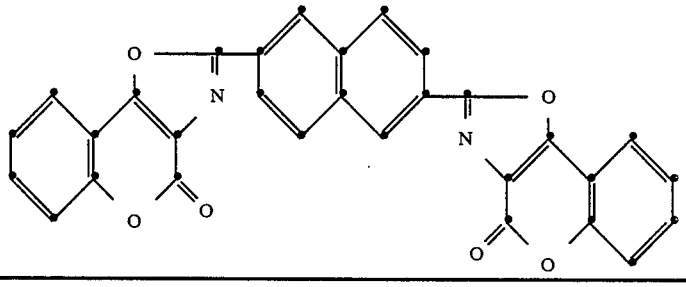

A visible dye can also be used in a separate area of the donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

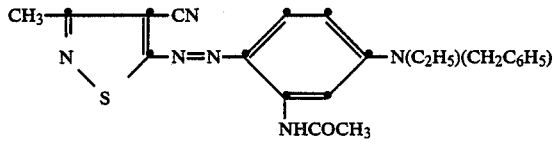

(magenta)

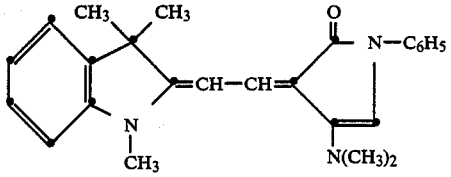

(yellow)

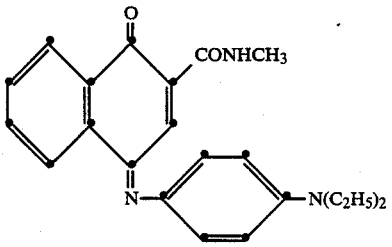

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The fluorescent material in the donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The fluorescent material layer of the donor element may be coated on the support or printed thereon by a printing technique such as a gravure process.

Any material can be used as the support for the donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness from about 2 to about 30 μm. It may also be coated with a subbing layer, if desired.

The reverse side of the donor element is coated with a slipping layer to prevent the printing head from sticking to the donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711 of Vanier, Harrison and Kan, 4,737,485 of Henzel, Lum and Vanier, 4,738,950 of Vanier and Evans, and 4,717,712 of Harrison, Vanier and Kan; and U.S. patent application Ser. No. 184,316 of Henzel and Vanier, filed Apr. 21, 1988. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The receiving element that is used with the donor element of the invention usually comprises a support having thereon an image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the receiving element may also be reflective such as baryta-coated paper, polyethylene-coated paper, white polyester (polyester with white pigment incorporated therein), an ivory paper, a condenser paper or a synthetic paper such as duPont Tyvek®.

The image-receiving layer may comprise, for example, a polycarbonate, a polyurethane, a polyester, polyvinyl chloride, poly(styrene-co-acrylonitrile), poly(caprolactone) or mixtures thereof. The image-receiving layer may be present in any amount which is effective for the intended purpose. In general, good results have been obtained at a concentration of from about 1 to about 5 g/m$^2$.

As noted above, the donor elements of the invention are used to form a transfer image. Such a process comprises imagewise-heating a donor element as described above and transferring a fluorescent material image to a receiving element to form the transfer image.

The donor element of the invention may be used in sheet form or in a continuous roll or ribbon. If a continuous roll or ribbon is employed, it may have only the fluorescent 7-aminocoumarin thereon as described above or may have alternating areas of different dyes, such as sublimable magenta and/or yellow and/or cyan and/or black or other dyes. Such dyes are disclosed in U.S. Pat. Nos. 4,541,830; 4,698,651 of Moore, Weaver and Lum; 4,695,287 of Evans and Lum; 4,701,439 of Weaver, Moore and Lum; 4,757,046 of Byers and Chapman; 4,743,582 of Evans and Weber; and 4,753,922 of Byers, Chapman and McManus; and U.S. patent application Ser. No. 095,796 of Evans and Weber, filed Sept. 14, 1987, the disclosures of which are hereby incorporated by reference. Thus, one-, two-, three- or four-color elements (or higher numbers also) are included within the scope of the invention.

In a preferred embodiment of the invention, the donor element comprises a poly(ethylene terephthalate) support coated with sequential repeating areas of magenta, yellow, and cyan dye and the fluorescent material as described above, and the above process steps are sequentially performed for each color to obtain a three-color dye transfer image containing a fluorescent image.

Thermal printing heads which can be used to transfer fluorescent material and dye from the donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal transfer assemblage of the invention comprises (a) a donor element as described above, and (b) a receiving element as described above, the receiving element being in a superposed relationship with the donor element so that the fluorescent material layer of the donor element is in contact with the image-receiving layer of the receiving element.

The following example is provided to illustrate the invention.

EXAMPLE

A donor element was prepared by coating the following layers in the order recited on a 6 μm poly(ethylene terephthalate) support:

(1) a subbing layer of duPont Tyzor TBT® titanium tetra-n-butoxide (0.16 g/m$^2$) from 1-butanol; and (2) a layer containing the fluorescent material as identified above or control fluorescent material identified below (0.16 g/m$^2$) in a cellulose acetate propionate (2.5% acetyl and 45% propionyl) binder (0.32 g/m$^2$) coated from a cyclopentanone, toluene and methanol solvent mixture.

On the back side of the element was coated:

(1) a subbing layer of Bostik 7650® (Emhart Corp.) polyester (0.11 g/m$^2$) coated from toluene; and (2) a slipping layer of Gafac RA-600® (GAF Corp.) polymer (0.043 g/m$^2$) and BYK-320® (BYK Chemie, USA) (0.016 g/m$^2$) in a poly(styrene-co-acrylonitrile) binder (70:30 wt. ratio) (0.54 g/m$^2$) coated from a toluene and 3-pentanone solvent mixture.

Control Materials

The following materials are available commercially from Kodak Laboratory Products and Chemicals Division:

Control 1

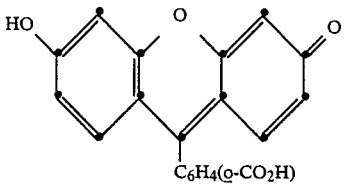

Fluorescein

-continued

Control 2

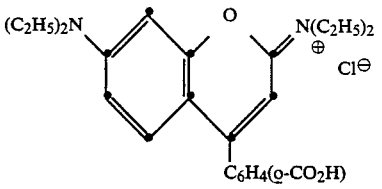

Rhodamine B

Control 3

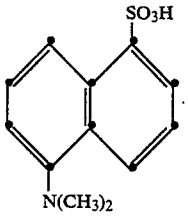

DANS Acid

Control 4

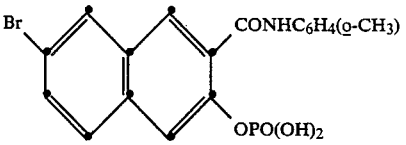

Naphthol AS-B1 phosphate

Control 5

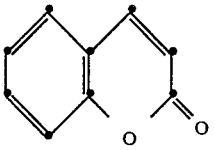

Coumarin

Control 6

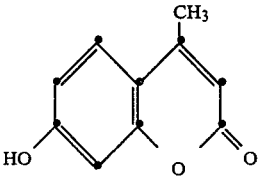

4-methyl, 7-hydroxy coumarin

A receiving element was prepared by coating a solution of Makrolon 5705® (Bayer A.G. Corporation) polycarbonate resin (2.9 g/m$^2$) in a methylene chloride and trichloroethylene solvent mixture on a transparent 175 μm polyethylene terephthalate support.

The fluorescent material layer side of the donor element strip approximately 3 cm×15 cm in area was placed in contact with the image-receiving layer of the receiver element of the same area. The assemblage was fastened in the jaws of a stepper motor driven pulling device. The assemblage was laid on top of a 14 mm diameter rubber roller and a TDK Thermal Head L-133 (No. 6-2R16-1) and was pressed with a spring at a force of 3.6 kg against the donor element side of the assemblage pushing it against the rubber roller.

The imaging electronics were activated causing the pulling device to draw the assemblage between the printing head and roller at 3.1 mm/sec. Coincidentally, the resistive elements in the thermal print head were pulsed at a per pixel pulse width of 8 msec to generate a graduated density image. The voltage supplied to the print head was approximately 22 v representing approximately 1.5 watts/dot (12 mjoules/dot).

The receiving element was separated from the donor element and the relative emission was measured with a spectrofluorimeter using a fixed intensity 360 nm excitation beam. The following results were obtained:

TABLE

| Compound | Relative Emission* | Visual Color |
|---|---|---|
| 1 | 100 | Blue· |
| 2 | 8 | Yellow |
| 3 | 32 | Purple |
| 4 | 38 | Yellow |
| 21 | 74 | Blue |
| 22 | 12 | Yellow-Green |
| 23 | 4 | Yellow-Green |
| Control 1 | 0.3 | Not visible |
| Control 2 | 0.3 | Not visible |
| Control 3 | 0.3 | Not visible |
| Control 4 | 0.1 | Not visible |
| Control 5 | 0.8 | Not visible |
| Control 6 | 0.2 | Not visible |

*Compared to Compound 1, normalized to 100

The above results show that the compounds of the invention have much more fluorescence than the control compounds of the prior art.

The invention has been described in detail with particular reference to preferred embodiments thereof, but it will be understood that variations and modifications can be effected within the spirit and scope of the invention.

What is claimed is:

1. A donor element for thermal transfer comprising a support having on one side thereof a fluorescent 7-aminocoumarin compound dispersed in a polymeric binder, and on the other side thereof a slipping layer comprising a lubricant.

2. The element of claim 1 wherein said compound has the formula:

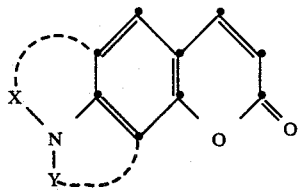

wherein: each X and Y independently represents hydrogen; a substituted or unsubstituted alkyl or acyl group having from 1 to about 10 carbon atoms; a substituted or unsubstituted aryl group having from about 6 to about 10 carbon atoms; or the atoms necessary to complete, along with the nitrogen to which it is attached, a 5- or 6-membered heterocyclic ring.

3. The element of claim 2 wherein X and Y are each hydrogen.

4. The element of claim 2 wherein X and Y are each methyl.

5. The element of claim 2 wherein X and Y are each ethyl.

6. The element of claim 2 wherein X and Y each represent the atoms necessary to complete a 6-membered heterocyclic ring.

7. The element of claim 1 wherein said donor element comprises sequential repeating areas of magenta, yellow and cyan dye, and said fluorescent compound.

8. In a process of forming a transfer image comprising imagewise-heating a donor element comprising a support having on one side thereof a layer comprising a material dispersed in a polymeric binder, and on the other side thereof a slipping layer comprising a lubricant, and transferring an image to a receiving element to form said transfer image, the improvement wherein said material is a fluorescent 7-aminocoumarin compound.

9. The process of claim 8 wherein said compound has the formula:

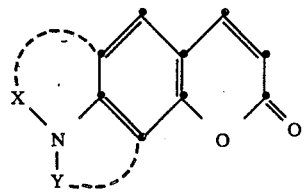

wherein: each X and Y independently represents hydrogen; a substituted or unsubstituted alkyl or acyl group having from 1 to about 10 carbon atoms; a substituted or unsubstituted aryl group having from about 6 to about 10 carbon atoms; or the atoms necessary to complete, along with the nitrogen to which it is attached, a 5- or 6-membered heterocyclic ring.

10. The process of claim 9 wherein X and Y are each hydrogen, methyl, ethyl or represent the atoms necessary to complete a 6-membered heterocyclic ring.

11. The process of claim 8 wherein said support is poly(ethylene terephthalate) which is coated with sequential repeating areas of magenta, yellow and cyan dye, and said fluorescent compound, and said process steps are sequentially performed for each color to obtain a visible three-color dye transfer image and a fluorescent image.

12. In a thermal transfer assemblage comprising:

(a) a donor element comprising a support having on one side thereof a layer comprising a material dispersed in a polymeric binder, and on the other side thereof a slipping layer comprising a lubricant, and (b) a receiving element comprising a support having thereon an image-receiving layer, said receiving element being in a superposed relationship with said donor element so that said material layer is in contact with said image-receiving layer, the improvement wherein said material is a fluorescent 7-aminocoumarin compound.

13. The assemblage of claim 12 wherein said compound has the formula:

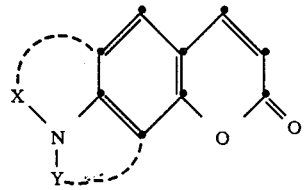

wherein: each X and Y independently represents hydrogen; a substituted or unsubstituted alkyl or acyl group having from 1 to about 10 carbon atoms; a substituted or unsubstituted aryl group having from about 6 to about 10 carbon atoms; or the atoms necessary to complete, along with the nitrogen to which it is attached, a 5- or 6-membered heterocyclic ring.

14. The assemblage of claim 13 wherein X and Y are each hydrogen, methyl, ethyl or represent the atoms necessary to complete a 6-membered heterocyclic ring.

15. The assemblage of claim 12 wherein said support of said donor element is poly(ethylene terephthalate) which is coated with sequential repeating areas of magenta, yellow and cyan dye, and said fluorescent compound.

* * * * *